United States Patent [19]

Schneider et al.

[11] 4,433,221

[45] Feb. 21, 1984

[54] IMPEDANCE CONTACT ASSEMBLY FOR AN ELECTRIC CIRCUIT BREAKER

[75] Inventors: Harold N. Schneider, Springfield; James H. Simpson, Media; Raymond F. Weidman, Springfield, all of Pa.

[73] Assignee: General Electric Company, King of Prussia, Pa.

[21] Appl. No.: 411,223

[22] Filed: Aug. 25, 1982

[51] Int. Cl.[3] ..... H01H 33/16

[52] U.S. Cl. ..... 200/144 AP; 200/150 E

[58] Field of Search ..... 200/144 AP, 150 R, 150 C, 200/150 E, 150 D

[56] References Cited

U.S. PATENT DOCUMENTS 2,752,459 6/1956 Taylor et al. ..... 200/150 D

*Primary Examiner*—E. A. Goldberg
*Assistant Examiner*—Morris Ginsburg
*Attorney, Agent, or Firm*—William Freedman

[57] ABSTRACT

For connecting a shunting impedance to a contact rod of a circuit breaker, there is provided an impedance contact assembly comprising a metal ring, two slots in the ring at diametrically-opposed locations, and a U-shaped metallic spring member having two spaced-apart arms and a bight portion. The spring member, which is positioned with its bight portion in one slot and the free ends of its arms in the other slot, has a resilience tending to bias the arms apart and against the walls of said other slot. The contact rod has a path of movement that extends between the spaced arms so that the arms slidably engage the contact rod at its opposite sides as the contact rod moves along this path.

5 Claims, 3 Drawing Figures

IMPEDANCE CONTACT ASSEMBLY FOR AN ELECTRIC CIRCUIT BREAKER

BACKGROUND

This invention relates to an electric circuit breaker and, more particularly, to a circuit breaker that includes a shunting impedance, typically a resistor, connected across the separable interrupting contacts of the interrupter during a portion of a circuit-breaker operation.

The invention is particularly concerned with an impedance contact assembly for slidably connecting one end of such an impedance to a movable one of the interrupting contacts, which is preferably of rod form. This impedance contact assembly must be capable of carrying the impedance current between the movable interrupting contact and the impedance during circuit-breaking and/or circuit-making operations and must also be capable of repetitively withstanding without damage any arcing that might develop at the impedance contact assembly during either of these operations.

SUMMARY

An object of our invention is to provide a simple and inexpensive impedance contact assembly that can effectively perform the above-described functions.

Another object is to provide an inexpensive impedance contact assembly that comprises a U-shaped spring member that engages the movable contact rod at opposite sides of the contact rod and utilizes such engagement to provide high pressure contact at these and other interfaces where current is transferred.

Another object is to provide simple and effective holding means for capturing such a U-shaped spring member in its operative position.

Still another object is to provide a simple and inexpensive impedance contact assembly which is easy to assemble and disassemble and requires no special fastening devices for holding its components in an operative condition.

In carrying out our invention in one form, we provide the following: a pair of separable interrupting contacts, one of which is a contact rod movable along its longitudinal axis during circuit-making and breaking operations; an impedance contact assembly for making contact with the contact rod at opposite sides of the contact rod when the contact rod is located near the other interrupting contact; and an impedance connected between the impedance contact assembly and the other interrupting contact. The impedance contact assembly comprises: a ring of conductive metal, two slots in the ring at diametrically-opposed locations, and a U-shaped metallic spring member having two spaced-apart arms and a bight portion. The spring member, which is positioned with its bight portion in one slot and the free ends of its arms in the other slot, has a resilience tending to bias the arms apart and against the walls of said other slot. The path of movement of the contact rod extends between the spaced-apart arms so that the arms slidably engage the contact rod at its opposite sides as the contact rod moves along said path. At the end of a circuit-breaking operation, the contact rod leaves the space between the arms, forming an arc for a brief period between the contact rod and one of the arms. The contact rod has a diameter sufficiently large as to force the free ends of the arms into higher pressure engagement with the walls of said other slot when the contact rod reenters the space between the arms during a circuit-making operation.

BRIEF DESCRIPTION OF THE DRAWINGS

For a better understanding of the invention, reference may be had to the following description taken in connection with the accompanying drawings, wherein.

.

DETAILED DESCRIPTION OF PREFERRED EMBODIMENT

Figure 1:
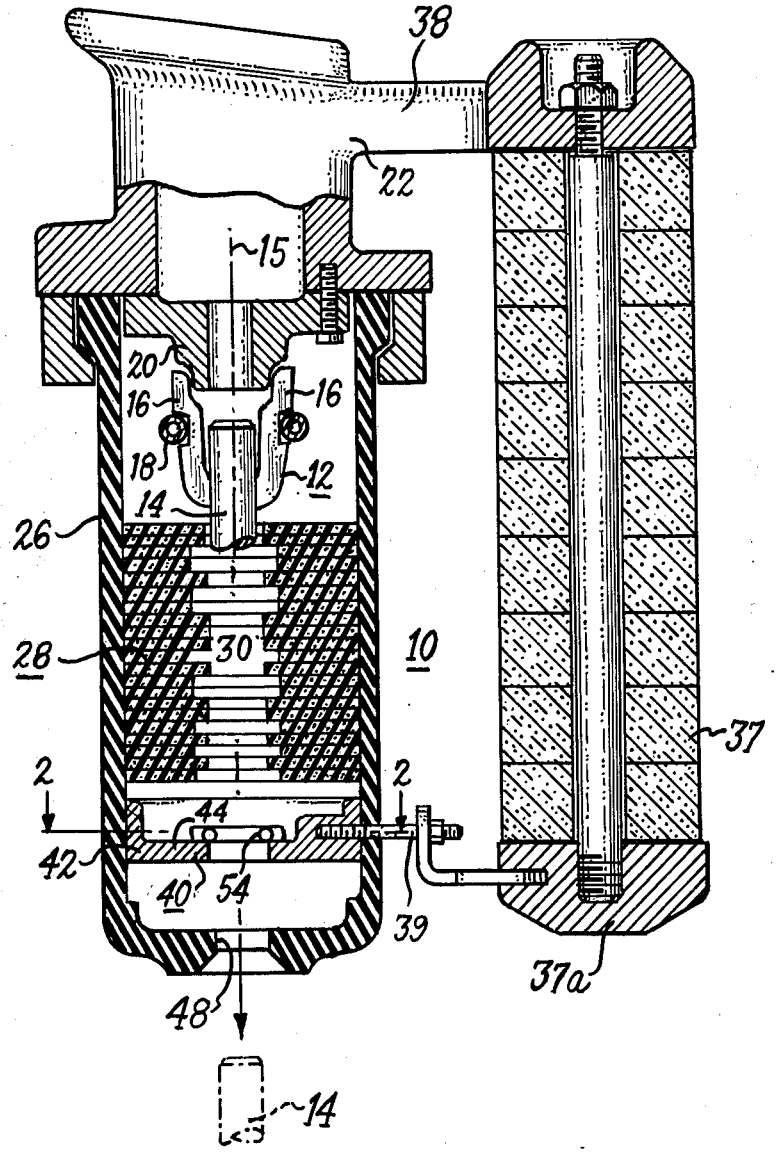
FIG. 1 is a cross-sectional side elevational view of a portion of a circuit breaker embodying one form of our invention.

Referring now to FIG. 1, there is shown an interrupter 10 for an oil circuit breaker. The interrupter is filled with and surrounded by suitable conventional circuit breaker oil. The interrupter comprises a pair of separable interrupting contacts 12 and 14. Interrupting contact 14 is a contact rod of conductive metal that has a vertical longitudinal axis 15 along which the contact rod is movable during circuit-making and circuit-breaking operations.

The other interrupting contact 12 is a stationary assembly of conventional form comprising a plurality of fingers 16 arranged concentrically about the axis 15. Suitable spring means 18 biases the fingers 16 radially inward. The upper ends of the fingers 16 bear against and make contact with a conductive adapter member 20. The lower ends of the fingers 16 bear against and make contact with the contact rod 14 when the interrupter is closed, as shown in FIG. 1.

The interrupter 10 is supported, at its upper end, by a conductive support 22 that, in turn, is supported from the lower end of an insulating bushing (not shown). The main current path through the interrupter, when it is closed, is through the support 22, the adapter 20, and the interrupting contacts 12 and 14.

When the circuit breaker is to be opened, the contact rod 14 is driven downwardly by suitable means (not shown), thereby separating the contacts 12 and 14 and establishing an arc therebetween. The interrupting contacts are surrounded by oil, and the arc reacts with this oil to develop pressures which create a flow of liquid and gases, acting eventually to extinguish the arc.

For controlling the pressures developed and the pattern of flow within the interrupter 10, a tube 26 of insulating material is disposed about the contacts 12 and 14, and a baffle stack 28 of insulating plates is disposed within this tube 26 just beneath the stationary contact 12. The baffle stack 28 has a central passage 30 through which the contact rod 14 extends. When the contact rod moves downwardly through this passage 30 during an interrupting operation, the lower terminal of the arc moves downwardly with the contact rod during a portion of the downward stroke.

There are other passages (not shown) within the baffle stack through which the arcing products flow, some of them exiting through aligned passages (not shown) in the insulating tube 26. The details of the baffle stack may be conventional and thus are not shown.

Just beneath the baffle stack 28 is a resistor contact assembly 40. This contact assembly 40 serves, among other things, to connect the lower end of a shunting resistor 37 to the movable contact rod 14 when the contact rod 14 is in or near its solid-line closed position of FIG. 1. The lower end of the resistor 37 includes a conductive terminal 37*a* that is connected to a portion of contact assembly 40 through a conductive stud 39. The upper end of the shunting resistor 37 is electrically connected to the conductive support 22 through a projecting portion 38 on support 22. Thus, resistor 37 is connected in parallel with the interrupting contacts 12 and 14 when the circuit breaker is closed. Virtually no current flows through the resistor 37 during this period because the path through the interrupting contacts has a much lower impedance than that through the resistor 37.

When the rod contact 14 is withdrawn from stationary contact 12 during an opening operation to establish an arc, the resulting arc voltage causes some current to flow through the shunting resistor 37. After a natural current zero, the shunting resistor continues to conduct a small amount of current around the gap between the contacts 12 and 14 and serves in a conventional manner to reduce the rate at which the usual recovery voltage transient builds up across the gap.

During a circuit-breaking operation, there is normally no arcing between the contact rod 14 and the resistor contact assembly 40 during the time the contact rod 14 remains within the resistor contact assembly. But as the downward opening stroke of the contact rod 14 continues, the upper end of the contact rod passes downwardly below the resistor contact assembly 40 and draws an arc between the resistor contact assembly and the upper end of the contact rod. This arc is usually a relatively low current arc since the main arc will then have been extinguished and the current then passing through the interrupter is following a path through the shunting resistor 37. This arc is soon extinguished by the pressures within the interrupter combined with the flow through the central passage 48 in the interrupter tube 26.

Figure 3:
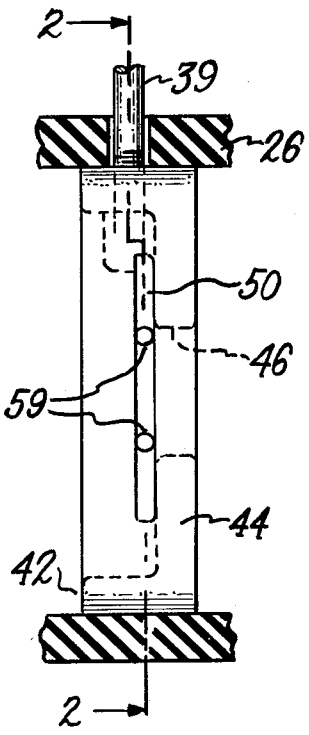
FIG. 3 is a sectional view taken along the line 3—3 of FIG. 2.
Figure 2:
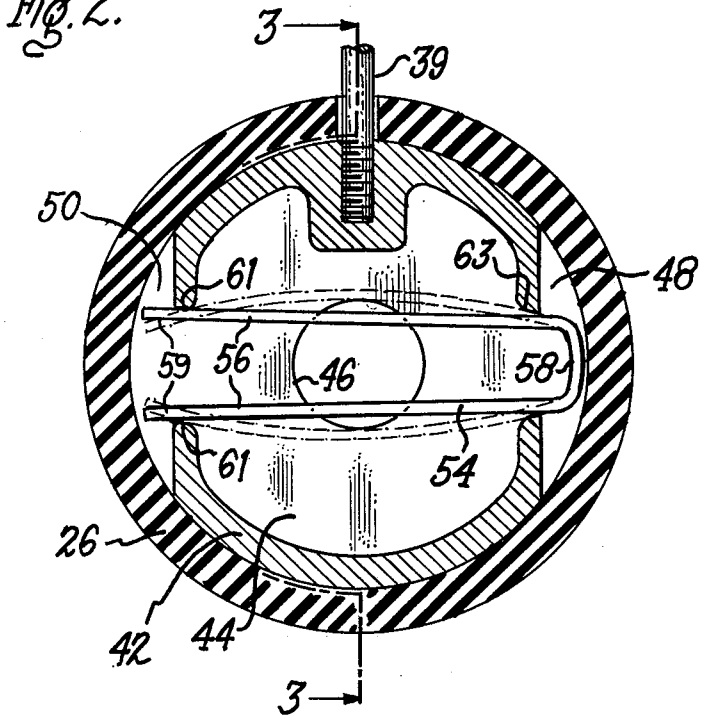
FIG. 2 is an enlarged sectional view taken along the line 2—2 of FIG. 1.

Referring to FIGS. 2 and 3, the resistor contact assembly 40 comprises a conductive ring 42 that closely fits within the insulating tube 26 in concentric relationship to the insulating tube. This ring 42 is preferably made of a suitable bronze. At the lower face of ring 42 there is a disc portion 44 that extends radially of the ring. This disc portion 44 has a central opening 46 through which the contact rod 14 freely extends.

Referring to FIG. 2, the ring 42 contains a pair of slots 48 and 50 located at diametrically opposed sides of the ring. Located within these slots is a U-shaped spring member 54 that comprises a pair of spaced-apart arms 56 having free ends 59 and a bight portion 58 interconnecting the arms at their other ends. The bight portion 58 is located within slot 48, and the free ends 59 are located within slot 50. The U-shaped spring member 54, which is preferably of phosphor bronze, has a springiness, or resilience, that tends to bias the free ends 59 of arms 56 apart and into engagement with the walls 61 of the slot 50. At the bight portion 58, there is a slight amount of looseness between the U-shaped spring member 54 and the walls 63 of the slot 48, leaving a small clearance between at least one of the arms and the adjacent wall of the slot 48.

The path of movement of the contact rod 14 extends between the spaced-apart arms 56. When the contact rod 14 is in its fully-open position outside the interrupter, as shown by dotted lines in FIG. 1, the U-shaped spring member 54 occupies the solid-line position of FIG. 2. During a circuit-making operation, the contact rod 14 is driven upwardly so that its upper end first moves through the resistor contact assembly 40 and then upwardly into engagement with the stationary interrupting contact 12. This upper end of the movable contact rod 14 has a tapered or rounded configuration so that, upon reaching the U-shaped spring member 54, it drives the arms 56 of the spring member apart by a wedging or camming action, causing them to deform from their solid line configuration of FIG. 2 into their dotted-line configuration. Thereafter, the arms 56 slidably engage the contact rod 14 at its opposite sides so long as the upper end of the contact rod is located above the U-shaped spring member.

When the contact rod 14 is not present between the arms 56 of the spring member 54, good contact is made between the free ends 59 of the arms 56 and the walls 61 of slot 50 due to the above-described outward bias on the arms produced by the resilience of the spring member. When the arms 56 are forced apart into their dotted-line position of FIG. 2 by the insertion and presence of the contact rod 14 therebetween, the free ends 59 of the arms 56 are forced to make higher pressure contact with the walls 61 of the slot 50. This higher pressure contact at 59, 61 further reduces the resistance of the interface and thus further facilitates current transfer between the ring 42 and spring member 54.

The deflection of the arms 56 into their dotted line position has the additional desirable function of increasing the contact pressure between the arms 56 and the contact rod 14, thereby facilitating current transfer between these parts when the upper end of the contact rod is in any position above the U-shaped spring member 54.

The slight looseness of the bight portion 58 of the spring member 54 in the slot 48 is desirable for several reasons. First of all, it allows for some lateral shifting or rocking of the spring member 54 so that the spring member can more easily receive the contact rod 14 should the contact rod's central axis, for some reason, be slightly off-center with respect to the center of ring 42. Secondly, this lateral shifting allows the spring member 54 to apply substantially equal forces to opposite sides of the contact rod 14, thus helping to balance the lateral forces on the contact rod and also helping to more equally distribute current between the two current-transfer interfaces at opposite sides of the contact rod.

Another advantage of the slight looseness at the bight portion of the U-shaped spring is that it facilitates assembly of the spring into the slots 50 and 48 of the ring 42. More specifically, while the ring 42 is still outside the interrupter 10, an assembler, working by hand and with no tools, can laterally insert the spring into the ring, easily inserting the bight portion 58 through the slot 50 and then into the slot 48. This lateral insertion operation, with the bight 58 located at the leading end, automatically forces the normally spread-out arms 56 into their more closely spaced solid-line position of FIG. 2.

During a circuit-breaking operation, the contact rod 14 is driven downwardly from its solid line position of FIG. 1 to its dotted-line position. The arms 56 of the spring member remain in firm contact with the contact rod 14 until the upper end of the contact rod passes beneath the U-shaped member 54. When this occurs, the previously-noted arc is drawn between the upper end of the contact rod 14 and one of the arms 56 of the spring member 54. The upper terminal of this arc quickly transfers off of the arm 56 and onto the disc. portion 44 of the ring 42, and this quick transfer reduces arc erosion of the arm 56. The disc portion 44 can withstand arcing with less chance for damage due to its much larger mass.

There are several factors contributing to quick transfer of the upper arc terminal from arm 56 onto the disc portion 44 of ring 42. One of these is that the arm 56 acts as an arc runner along which the arc terminal can readily move onto the disc portion 44. In this connection, note that most of the current flowing via U-shaped member 54 into an arc terminal thereon enters the U-shaped member through the free ends 59 of the arms of the U-shaped member (since the bight end 58 is loose in slot 48). Most of this current enters through that interface at 59, 61 which is closest to the arc, and this greater current entering the arc from one side creates an unbalanced magnetic force on the arc tending to drive it toward the bight portion 58. In moving in this direction, the arc engages the disc portion 44, and its terminal immediately transfers to the disc portion. The fact that the disc portion 44 is located between the two vertically-spaced arc terminals also positions the disc portion so that the arc can be readily transferred to it.

Although the spring member is protected from heavy arcing duty by the above described quick transfer of the upper arc terminal, we further protect it by utilizing for it an arc-resistant material, which in a preferred embodiment is phosphor bronze.

As noted hereinabove, the U-shaped spring member 54 can be easily assembled within the ring 42 simply by inserting it through the slots 50 and 48. It is to be further noted that when the ring 42 is placed within the tubular housing 26 of the interrupter, the U-shaped spring is held in place by the surrounding housing without any other fastening means. There is no hardware to tighten and nothing to loosen during operation of the circuit breaker.

While we have shown and described a particular embodiment of our invention, it will be obvious to those skilled in the art that various changes and modifications may be made without departing from our invention in its broader aspects; and we, therefore, intend herein to cover all such changes and modifications as fall within the true spirit and scope of our invention.

What we claim is:

1. In an electric circuit breaker, (a) a pair of separable interrupting contacts, one of which comprises a contact rod having a longitudinal axis along which said contact rod is movable during circuit-making and circuit-breaking operations, (b) an impedance contact assembly for making electrical contact with said contact rod along two sides of said contact rod when the contact rod is located near the other interrupting contact, (c) an impedance connected between said impedance contact assembly and said other separable interrupting contact, (d) said impedance contact assembly comprising:

(i) a ring of conductive metal to which said impedance is electrically connected, (ii) two slots in said ring at diametrically-opposed locations, (iii) a U-shaped spring member of conductive metal having two spaced-apart arms and a bight portion interconnecting said arms at one end of the arms, the other end of the arms constituting free ends, the spring member being positioned with its bight portion in one of said slots and the free ends of said arms in the other of said slots and having a resilience tending to bias said free ends apart and against the walls of said other slot, (e) the path of movement of said contact rod extending between said spaced-apart arms so that said arms slidably engage said contact rod at opposite sides thereof as said contact rod is moved along said path while near said other interrupting contact, (f) said contact rod at the end of a circuit-breaking operation leaving the space between said spaced-apart arms and forming an arc between said contact rod and one of said arms, and (g) said contact rod having a diameter sufficiently large as to force said free ends of said arms into higher pressure engagement with the walls of said other slot when the contact rod reenters the space between said arms during a circuit-making operation.

2. The structure of claim 1 in combination with a tube of insulating material surrounding the gap formed between said interrupting contacts when said interrupting contacts are separated, said insulating tube also surrounding said ring of conductive metal and holding said U-shaped spring member captive in said slots.

3. The structure of claim 1 in combination with a tubular member surrounding said ring of conductive metal and holding said U-shaped spring member captive in said slots.

4. The structure of claim 1 in which said ring of conductive metal comprises a metallic disc portion extending radially of said ring and having a central opening therein for receiving said rod contact, said arms extending across said central opening at opposite sides thereof when said contact rod is in its fully-open position.

5. The structure of claim 4 in which said disc portion is located between said spring member and the end of said contact rod when the contact rod leaves the space between said arms, thus facilitating quick transfer of an arc terminal from the arm of said spring member to said disc portion.

* * * * *